United States Patent [19]

Weston et al.

[11] Patent Number: 5,061,196

[45] Date of Patent: Oct. 29, 1991

[54] SELECTIVE SHORTING OF PLUG PINS/SOCKET CONTACTS IN AN ELECTRICAL CONNECTOR

[76] Inventors: Roy E. Weston, 144 Stanton Road, Sandiacre, Noots, England, NG105EP; John T. Guennewig, 1107 Peregrine Drive, Palatine, Ill. 60067; John DeBrocke, 1250 S. Ferndale, Highland Park, Ill. 60035; Fred Radloff, 237 Hays Dr., Northlake, Ill. 60164

[21] Appl. No.: 528,245

[22] Filed: May 24, 1990

[30] Foreign Application Priority Data

May 24, 1989 [GB] United Kingdom ..... 8911900

[51] Int. Cl.[5] ..... H01R 31/08

[52] U.S. Cl. ..... 439/189; 439/49; 439/511

[58] Field of Search ..... 439/49, 189, 109, 507, 439/510–512, 514–516

[56] References Cited

U.S. PATENT DOCUMENTS

| | | | |
|---|---|---|---|
| 3,871,728 | 3/1975 | Goodman | 439/49 |
| 4,429,935 | 2/1984 | Lamb et al. | 339/32 |
| 4,591,221 | 5/1986 | DeBrouckere et al. | 439/511 |
| 4,755,151 | 7/1988 | Beaulieu et al. | 439/395 |
| 5,000,699 | 3/1991 | Nadin | 439/511 |

FOREIGN PATENT DOCUMENTS

| | | |
|---|---|---|
| 0112711 | 12/1983 | European Pat. Off. . |
| 0240453 | 3/1987 | European Pat. Off. . |
| 700893 | 12/1953 | United Kingdom . |
| 2074797 | 11/1981 | United Kingdom . |

*Primary Examiner*—Paula A. Bradley
*Attorney, Agent, or Firm*—Joseph P. Calabrese

[57] ABSTRACT

A shorting link is provided having legs adapted to interlock with contacts of an electrical connector. The contacts may be connected by the link to ground, or one or more of the link-connected contacts may also engage conductors in an electrical circuit. In one link embodiment the link legs may comprise contacts housed in a connector insulator for engaging mating contacts of a mating connector.

3 Claims, 5 Drawing Sheets

SELECTIVE SHORTING OF PLUG PINS/SOCKET CONTACTS IN AN ELECTRICAL CONNECTOR

BACKGROUND OF THE INVENTION

1. Field of the Invention

The present invention relates to a method and device for shorting together selected plug pins and/or socket contacts of an electrical connector while leaving the other plug pins/socket contacts free for connection to other leads.

During manufacture or assembly of an electrical connector it is often necessary to short together two or more of the pins (if it is a plug) or contacts (if it is a socket), for example so that they may be attached to an earth lead via a single connection. Conventionally, this is done for example by soldering a lead to the rear end of each plug pin or socket contact which is to be shorted and then soldering together the leads. This method is laborious and the resulting network of junctions at the rear of the insulating connector body can obstruct the connections of other leads to the individual unshorted plug pins or socket contacts.

SUMMARY OF THE INVENTION

The present invention provides a shorting link for selectively shorting together plug pins and/or socket contacts which assemble into the insulating body of an electrical connector.

The shorting link of the present invention is a flat blank of conductive material comprising a plurality of legs formed on a connecting portion. In certain embodiments of the invention the rear ends of the plug pins or socket contacts to be shorted are formed for crimping engagement to respective legs of the shorting link while it is flat and then the legs are bent relative to the connecting portion so that the plug pins or socket contacts are in the correct attitude for introduction into the insulating connector body.

The shorting link of this invention is readily assembled with contacts of known construction, such as contacts employed in solderless termination systems including systems employing insulation-displacing contacts, as will hereinafter be described in greater detail.

In yet other embodiments of the invention the legs of the shorting link themselves form plug pins or socket contacts of the electrical connector. In these cases the shorting link need not be made as a flat blank but could be formed in a bent shape suitable for inserting the legs into the insulating connector body.

Features and advantages of the present invention will become clear from the following description of an embodiment thereof, given by way of example, illustrated by the accompanying drawings in which:

FIG. 1(*a*) is a top plan view,

FIG. 1(*b*) is a front elevational view,

FIG. 1(*c*) is a rear elevational view, and

FIG. 1(*d*) is a left side elevational view partially cut away;

FIG. 2(*a*) is a front elevational view,

FIG. 2(*b*) is a left side elevational view,

FIG. 3(*a*) is a top plan view,

FIG. 3(*b*) is a section along line A—A′ of

Figure 1A:
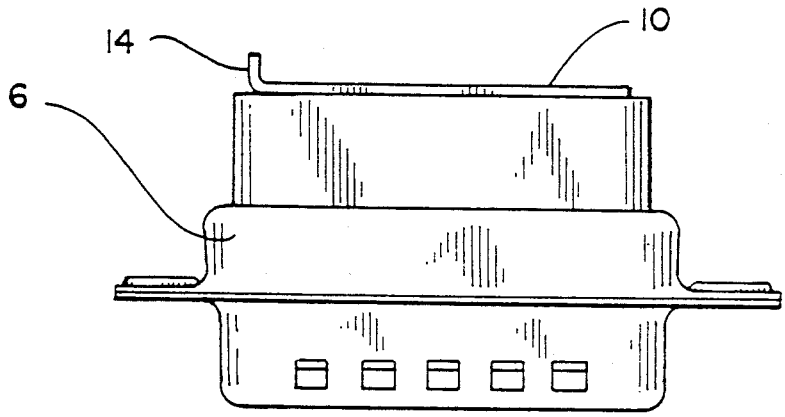
FIG. 1 shows an electrical connector incorporating a shorting link according to the present invention.
Figure 1B:
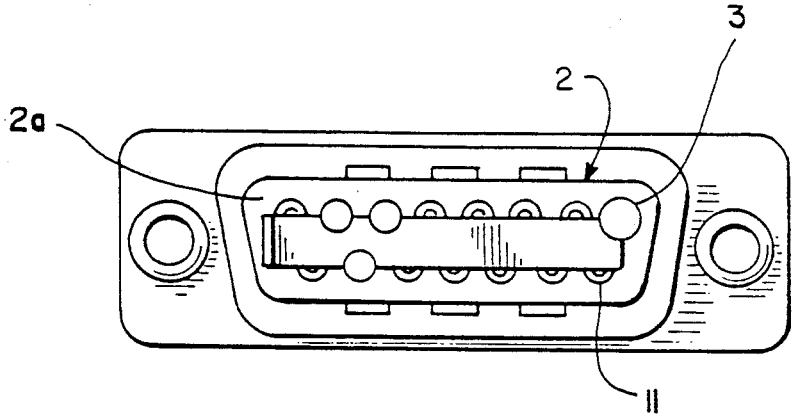
Figure 1C:
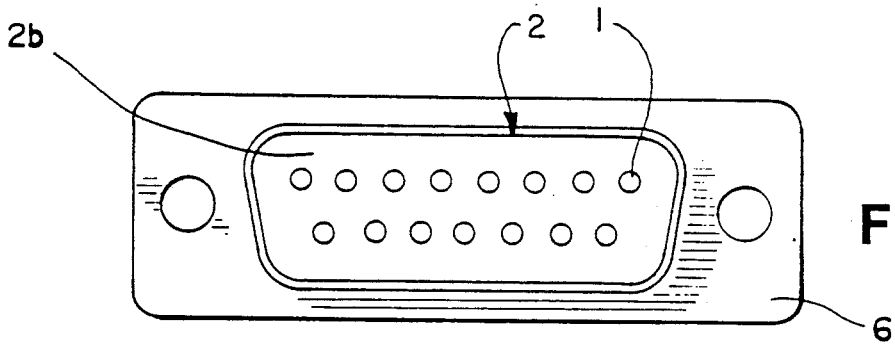
Figure 1D:
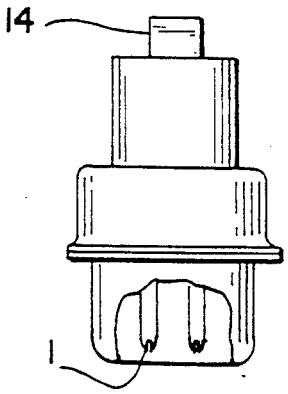
Figure 2A:
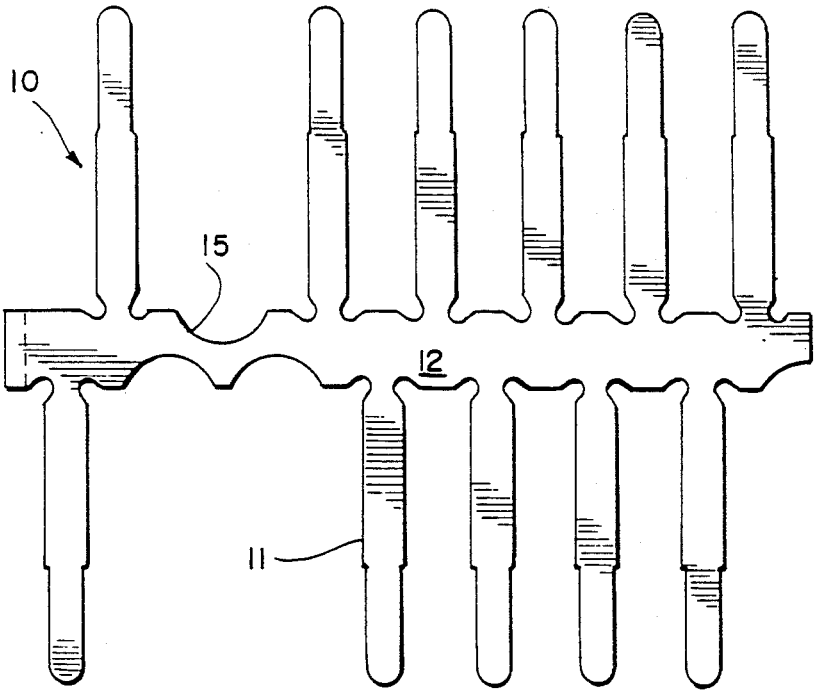
FIG. 2 shows as a blank the shorting link of FIG. 1.
Figure 2B:
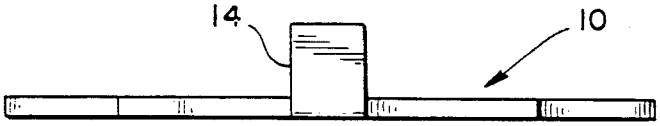
Figure 4:
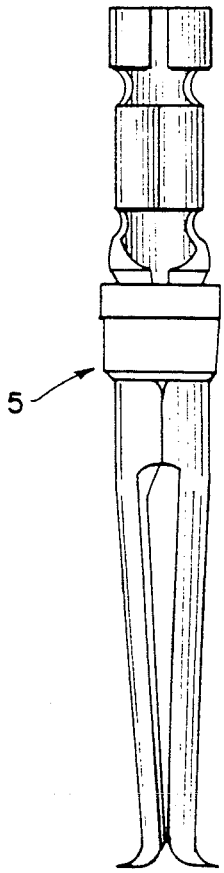
Figure 3B:
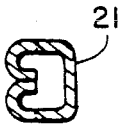
FIG. 3 shows a pin contact of FIG. 1.
Figure 3C:
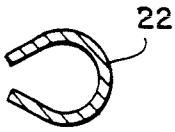
Figure 3A:
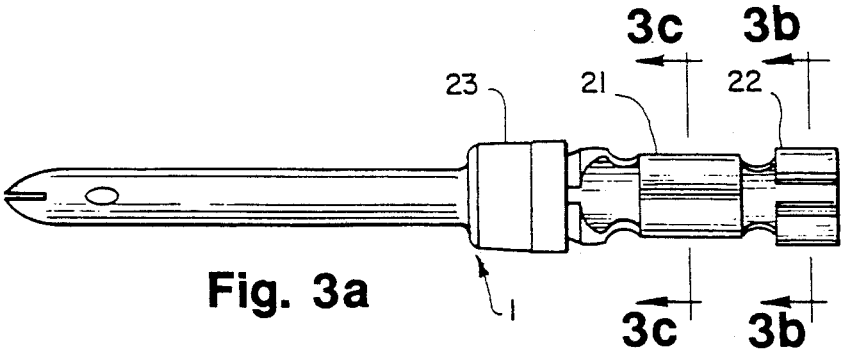
Figure 5:
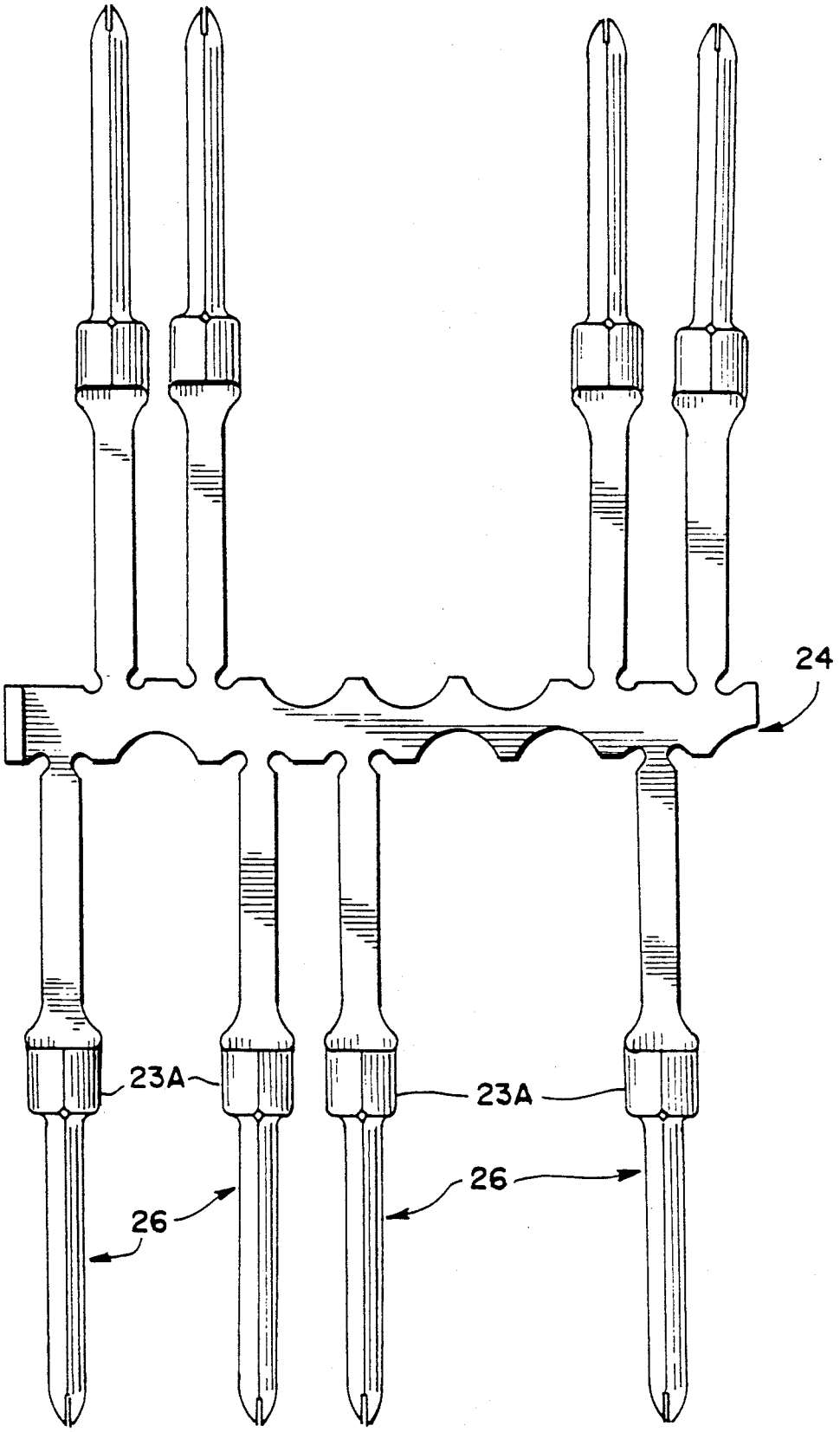
Figure 6:
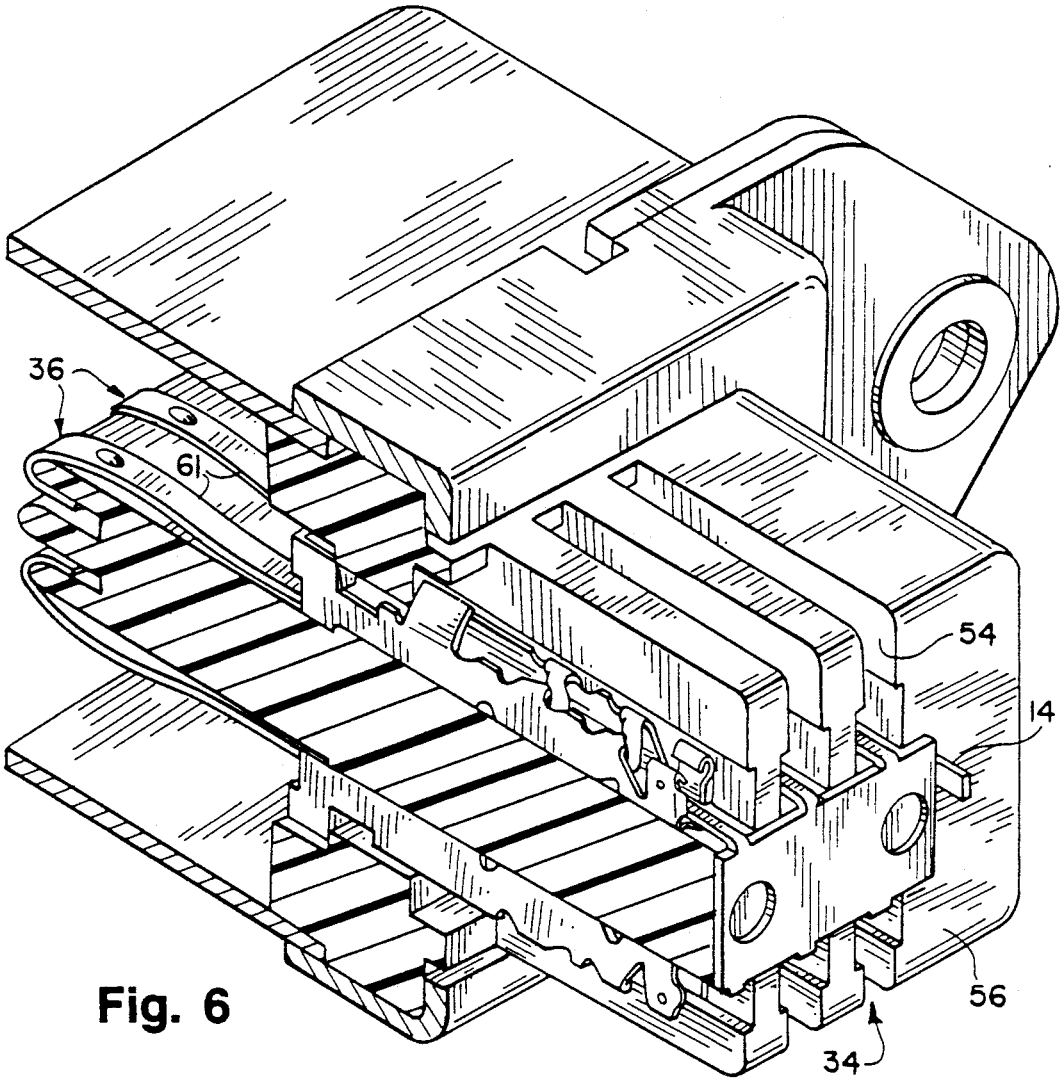
Figure 7:
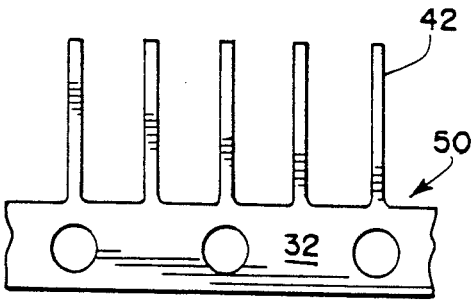
Figure 8:
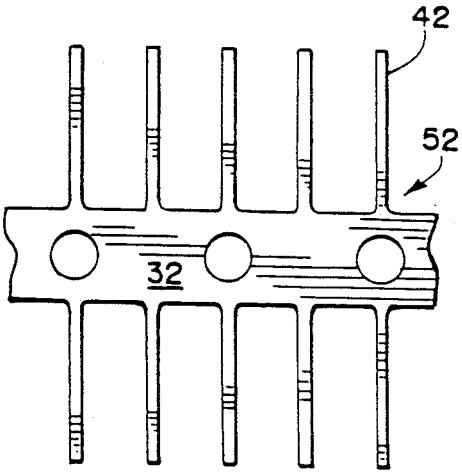
Figure 10:
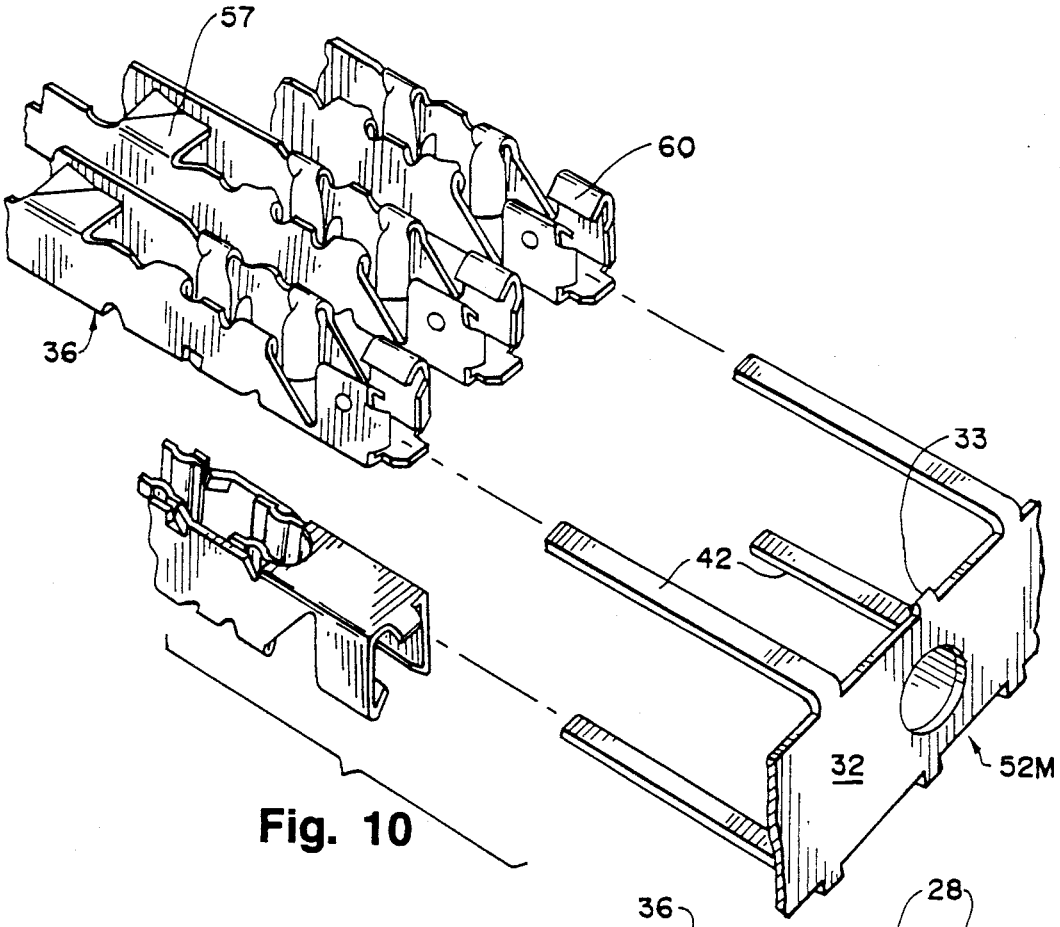
Figure 9:
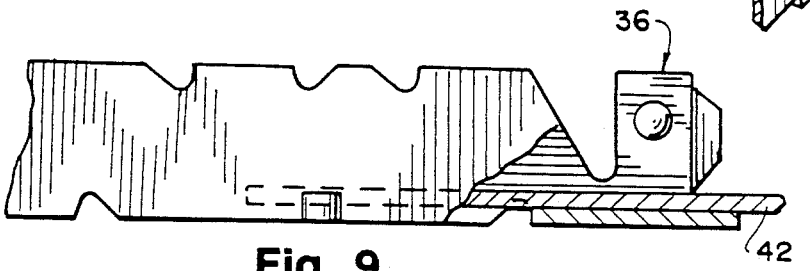
Figure 11:
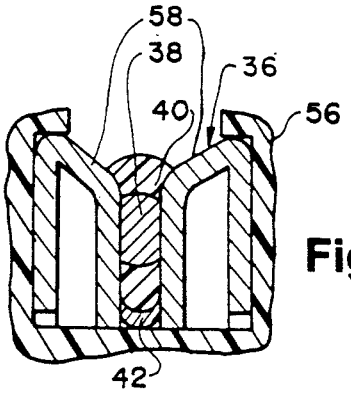
Figure 12:
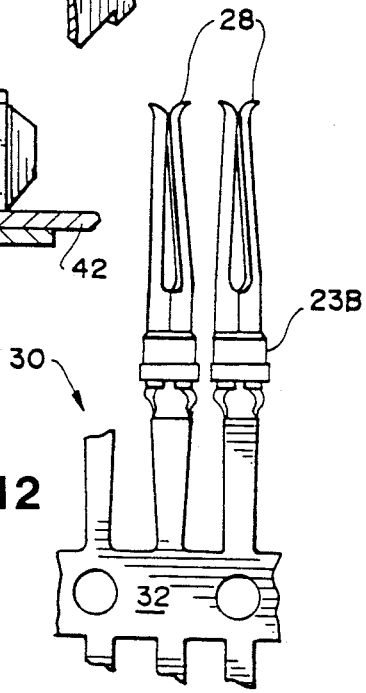

FIG. 3(*a*), and FIG. 3(*c*) is a section along line B—B′ of FIG. 3(*a*);

FIG. 4 is a view similar to FIG. 3(*a*) of a female contact adapted to engage a shorting link in the manner of the pin contact of FIG. 3(*a*);

FIG. 5 is a view similar to FIG. 2(*a*) in which the link legs comprise pin contacts;

FIG. 6 is a perspective sectional view, partially cut away, of an electrical connector having insulation displacement contacts housed therein, illustrated in engagement with a shorting link of this invention;

FIGS. 7 and 8 are plan views of shorting links similar to that of FIG. 2 as initially formed from a continuous strip and prior to bending the link legs into the condition of the shorting link illustrated in FIG. 10;

FIG. 9 is a fragmentary side elevational view of an insulation displacement contact, partially broken away in assembly with a leg of a shorting link of this invention;

FIG. 10 is a fragmentary perspective view of a link similar to that of FIG. 9 following bending for engagement with insulation-displacement contacts to be housed in the insulator of FIG. 6;

FIG. 11 is a transverse sectional view of a shorting link-contact assembly with a conductor of a wire terminated in the contact, and FIG. 12 is a view similar to FIG. 5 in which the link legs comprise female receptacle contacts.

DESCRIPTION OF THE INVENTION

FIG. 1 shows a multi-way (15 pin) D-type electrical connector plug incorporating a shorting link according to the present invention, with the unshorted plug pins omitted for greater clarity. Two staggered rows of plug pins 1 are mounted in an insulating body 2 made of moulded plastics material. In this example the insulating body 2 is a two-part moulding with a rear, open-fronted moulding 2*a* in which the plug pins 1 are mounted and a front moulding 2*b* through which the tips of the plug pins protrude.

A shorting link 10 is connected to the rear of each plug pin to be shorted together by a respective leg 11 passing into a hole 3 in the rear moulding 2*a* of the insulating body 2. Central portion 12 of the shorting link 10 extends along the rear of the insulating body 2 and is provided with an upstanding tab 14 at one end thereof for connection to an earth lead or the like.

The shorting link 10 is spaced from the insulating body 2 so that if the tab 14 is soldered to a lead, or any of the legs 11 are soldered to plug pins, or socket contact the heat will not be directly conducted to the moulding; thus melting of the moulding is prevented.

A two-part metal case 6 encloses the insulating connector body 2 to promote mating of the connector plug with a corresponding socket. The two halves of case 6 are held together in a conventional manner, e.g. eyeleted or riveted together.

FIG. 2 shows the shorting link 10 of FIG. 1 as a flat blank, i.e. before connection to the plug pins The number, spacing and staggering of the legs 11, and the width of the central portion 12, are specifically designed to match the characteristics of the connector plug of FIG. 1. Clearly, these factors may all be varied so as to produce shorting links for connectors of different types, and in particular to accommodate a single row of plug pins (or socket contacts), non-staggered parallel rows of plug pins/socket contacts, non-parallel rows of plug pins/socket contacts, and different numbers and/or pitches of plug pins/socket contacts. Shorting links according to the present invention may be made for circular plugs. One embodiment of such a shorting link has a "starfish" shape, i.e. with a circular or ring-shaped central portion and legs extending radially.

Each leg 11 of the shorting link 10 corresponds to the position of a plug pin to be shorted, in this case pins 2,3,4,5,8,9,10,11,12,13 and 15. Semi-circles of material are cut out from the shorting link 10 at locations 15 corresponding to plug pins which are not to be shorted, in this case pins 1, 6, 7 and 14. The shape of the cut-outs 15 is adapted to match the contours of the holes 3 in the rear of the connector insulating body 2 so that the shorting link 10 will not unduly obstruct the connections of leads to the rear of unshorted plug pins.

The shorting link 10 may be made from a range of conductive materials, e.g. plated and unplated metals, plated plastics. Brass is a convenient material to work with because it is easily formed, resilient, relatively cheap and a good conductor. The manufacturing process depends on the conductive material used for the shorting link: for a metal such as brass the shorting link may be made in a stamping press, for a plated plastics shorting link plastics material may be first moulded and then metallized.

For a given type of electrical connector the shorting link 10 may be manufactured with a full set of legs 11 so that the users may determine which plug pins/socket contacts are to be shorted together and remove the unwanted legs 11 themselves. Alternatively customized shorting links 10 may be manufactured which already have cut-outs 15 at the desired locations.

The legs of the shorting link 10 shown in FIG. 2 are in the form of flat blades with a section of reduced width at the end thereof remote from the central portion 12. This reduced width section is used to promote the attachment of plug pins/socket contacts by crimping. The connection of plug pins 1 to the legs 11 will now be described with reference to FIG. 3 which shows a pin contact designed for attachment to a lead by crimping. It is to be understood that the plug pins could be attached to the shorting link legs 11 by other methods, e.g. by soldering.

The pin contact 1 of FIG. 3 has a first crimp portion 21 and a second crimp portion 22 at the rear end thereof. As shown in FIGS. 3(*a*) and (*b*) the first crimp portion 21 is preferably already crimped before the pin is attached to the shorting link 10, while, as shown in FIGS. 3(*a*) and 3(*c*), the second crimp portion 22 is not crimped before attachment. The partially crimped rear end of the pin contact 1 is slid over the free end of a leg 11 of the shorting link so that the first crimp portion 21 makes a tight fit over the leg section of normal width and the second crimp portion 22 encircles the leg section of reduced width. The second crimp portion 22 is then crimped so as to prevent sideways movement of the leg 11 relative to the attached pin contact 1.

The pin contact 1 could be presented to the shorting link leg 11 in an uncrimped form rather than partially crimped as described above, however when the electrical connector involved has a narrow pitch between plug pins/socket contacts the space available for manoeuvre of a crimp tool is limited and it is preferable to use the partially formed crimp.

Connection of socket contacts to the legs 11 of the shorting link may be made in a similar way.

Once the selected plug pins/socket contacts have been attached to the appropriate legs 11 of the shorting link 10 the legs 11 are bent relative to the central portion 12, in this case to an angle of 90), so that the plug pins/socket contacts are correctly aligned for insertion into the rear of the rear moulding 2*a* of the insulating connector body 2. The legs 11 of the shorting link 10 of FIG. 2 are necked where they meet the central portion 12 so as to facilitate bending. When the shorted plug pins/socket contacts are inserted in the insulating connector body they are fixed in place. In this example fixing is achieved by means of a shoulder 23 provided on each plug pin/socket contact and a plurality of split collars (resembling cells of a beehive) provided inside the rear moulding 2*a*, each split collar aligned with a respective hole 3 in the rear moulding. On insertion of a plug/socket contact into a hole 3 in the rear moulding 2*a* the shoulder 23 forces apart the two halves of the respective collar until it has passed through and the collar halves snap back. The collar subsequently prevents the shoulder 23, and therefore the plug pin/socket contact, from moving backwards relative to the rear moulding 2*a*. Other conventional fixing methods could alternatively be used.

The other plug pins/socket contacts may now be attached (e.g. crimped or soldered) to their respective leads, inserted from the rear into the appropriate locations in the insulating connector body and fixed into place. When all of the plug pins/socket contacts have been mounted in the rear moulding then the front moulding 2*b* may be fitted over the plug pin tips (or free ends of the socket contacts) to prevent further forward motion thereof relative to the rear moulding 2*a*.

FIG. 5 is a plan view of a shorting link 24 in which the legs thereof comprise male contacts 26 similar to male contacts 1 of FIGS. 1 and 2. Collars 23A of the leg-contacts of FIG. 5 function similarly to collars 23 of the contacts 1 described above.

FIG. 12 is a fragmentary view illustrating a link-contact arrangement 30 in which the link legs comprise female contacts 28 adapted to receive a male pin blade or the like. Collar portions 23B of contacts 28 also function similarly to collars 23 of contacts 1. It will be noted that the female contacts 28 are similar to the female contact 4 illustrated in FIG. 5 with the exception that the collars adapted to engage a link leg are absent inasmuch as the same are unneeded.

The integral link-contact structures of FIGS. 5 and 12 dispense with the need for any link-contact engagement such as above described when separate links are employed for interfitting engagement with existing contacts. It will be noted by comparing FIGS. 5 and 12 that in FIG. 5 the link-contact arrangement is stamped from a conductive sheet and specific link legs may be omitted in the stamping operation 50 as to satisfy the shorting requirements of the connector in which the link is to be disposed.

In the shorting link-contact 30 of FIG. 12 the female contacts extend from a link carrier strip portion 32 from which the individual leg-contacts may be readily broken free in accordance with the shorting requirements of the connector with which the link 30 is to be employed. Thus, FIG. 10 illustrates formed link 22M in which a center top leg has been removed at junction 33 from central carrier portion 32.

FIG. 6 is a perspective view partially in section of an electrical connector 34 adapted to house a plurality of contacts 36 illustrated not only in FIG. 6 but also fragmentarily illustrated in FIGS. 9, 10 and 11. The illustrated connector housing and contact assembly defines a solderless termination system of the type disclosed in McKee U.S. Pat. No. 4,035,049; the disclosure of such patent is incorporated herein by reference. The contacts 36 of FIGS. 6, 9, 10 and 11 are adapted not only to effect desired electrical contact with a wire central conductor 38 (see FIG. 11) surrounded by insulation 40, but in addition the contacts 36 are readily engageable in a fixed relationship with legs 42 projecting from one side of carrier strip 32 as illustrated in FIG. 7 or from both sides of a carrier strip 32 as illustrated in FIG. 8. Shorting link 50 of FIG. 7 may have the legs 42 thereof pressed downwardly into slots 54 formed in the insulator of connector 34 until the legs 42 bottom on base portions of the contacts 36. It will be most apparent from the sectional view of FIG. 11 at a shorting link leg 42 is securely received between opposed insulation rupturing tabs 58 so as to deform opposed edge portions of each shorting link leg 42 engaged by each pair of insulation rupturing jaws 58. It is apparent from FIG. 11 that after a shorting link leg 42 is bottomed on the base of the illustrated contact 36 and the base of the insulator slot in which the contact is disposed a wire may be readily terminated between the opposed jaws 58 which readily cut through the surrounding insulation 40 in the course of effecting desired contact with the metallic core 38.

It will be noted form FIG. 10 and particularly from the lower contact 36 illustrated in the inverted positions that in the insulation displacement contact type illustrated there may be no contact floor between the opposed rupturing jaws 58. Accordingly as illustrated in FIG. 11 the shorting link may partially bottom on the insulator floor portion of the slot in which the contact 36 is disposed.

It is also evident from FIG. 10 as well as FIG. 6 that each contact 36 possesses two pairs of spaced insulation rupturing jaws 58 so that the conductor such as illustrated conductor 38 of FIG. 11 may be engaged twice by each contact 36. However, it is only necessary that the jaw pair 58 disposed closer to the open end of each insulator slot 54 as illustrated in FIG. 6 engage the shorting link legs.

The remaining contact structure such as locking tabs 58 which are adapted to be bent for interlocking with the insulator in which the contact is disposed is known to the art. Other known components of the illustrated contacts 36 are rear tabs 60 which prevent upward disengagement of a wire or wires after termination between the insulation rupturing jaws 58 of each contact and contact blades 61.

It is apparent from FIG. 11 that as each leg 42 is deformed in the course of insertion between the opposed contact jaws 58 such leg and the shorting link as a whole is securely retained to the contacts and connector regardless of whether wires comprising a core and surrounding insulation as illustrated in FIG. 11 are subsequently inserted into the contact.

Thus the provided shorting links may interconnect contacts having no conductors or leads attached thereto, with the link connected to ground as by means of a grounding tab 14 illustrated in FIG. 1 of the drawing. Contacts such as the insulation displacement contacts 36 of the drawing may be connected to a shorting link only and the contacts and link securely retained in assembled position by virtue of the deformation of the link legs in the manner illustrated in FIG. 11 of the drawing. Or, one or more of the contacts joined by the link may be in electrical communication with conductors of a circuit.

It is believed apparent that the specific form of the contacts, connector and shorting link may be varied without departing from the ambit of the invention above disclosed. The illustrated contacts 36 being presented by way of example only interlock with the insulation rupturing jaws 58 of contact 36 of the drawing as the width of the link legs are preferably approximately 0.002 to 0.004 inch greater in width than the interval between the jaws 58. The particular link configuration prior to bending may be stamped in a continuous process from a continuous strip of conductive material, in which the main link section from which the link legs extend comprises a carrier strip segment.

This invention is to be limited only by the scope of the appended claims.

What is claimed is:

1. An electrical connector comprising:

an insulating body having a plurality of apertures corresponding to the positions of the contacts of the electrical connector;

a shorting link of conductive material comprising a main section and a plurality of legs extending from, and being an integral part of said main section;

with each one of said plurality of legs extending into a respective one of said plurality of apertures and effecting electrical contact via said legs and main section of said shorting link between selected contacts;

said selected contacts being separated from said legs and attached to said legs prior to insertion into said insulating body.

2. An electrical connector comprising:

an insulating body having a plurality of apertures corresponding to the positions of the contacts of the electrical connector;

a shorting link of conductive material comprising a main section and a plurality of legs extending from, and being an integral part of said main section;

with each one of said plurality of legs extending into a respective one of said plurality of apertures and effecting electrical contact via said legs and main section of said shorting link between selected contacts;

said selected contacts being formed as an integral part of said legs.

3. A connector according to claim 1 or 2 wherein said main section of said shorting link further comprises a tab to enable a further electrical connection to be made to said shorting link.

* * * * *

UNITED STATES PATENT AND TRADEMARK OFFICE

CERTIFICATE OF CORRECTION

PATENT NO. : 5,061,196

DATED : October 29, 1991

INVENTOR(S) : Weston, R.; Guennewig, J.; DeBrocke, J. Radloff, F.

It is certified that error appears in the above-identified patent and that said Letters Patent is hereby corrected as shown below:

ON THE TITLE PAGE:

[76] Inventors:

First inventor's residence, "Noots" should read "Notts"

Third inventor's street address - delete the "S.".

Column 2, line 60 after the word "pins" add -- 1. --;

Column 2, line 61 the paragraph starting with "The number," should not be a paragraph; and Column 3, line 49 after the word "pin" add -- 1 --.

Signed and Sealed this

Thirteenth Day of April, 1993

*Attest:*

STEPHEN G. KUNIN

*Attesting Officer*

*Acting Commissioner of Patents and Trademarks*